US005464491A

United States Patent [19]

Yamanaka

[11] Patent Number: 5,464,491

[45] Date of Patent: Nov. 7, 1995

[54] METHOD OF PRODUCING MAT COMPRISING FILAMENT LOOP AGGREGATE

[75] Inventor: Minoru Yamanaka, Tokyo, Japan

[73] Assignee: Kabushiki Kaisha Risuron, Tokyo, Japan

[21] Appl. No.: 106,043

[22] Filed: Aug. 12, 1993

[51] Int. Cl.[6] ..... D01D 5/22; D01D 7/00

[52] U.S. Cl. ..... 156/167; 156/181; 156/244.26; 264/168; 264/178 F; 264/211.14

[58] Field of Search ..... 156/167, 181, 156/244.26, 244.27; 264/168, 178 F, 211.14, 562, 179, 180

[56] References Cited

U.S. PATENT DOCUMENTS

| | | | |
|---|---|---|---|
| Re. 27,614 | 4/1973 | Brunner | 428/95 |
| 3,481,821 | 12/1969 | Brunner | 428/95 |
| 3,686,049 | 8/1972 | Manner | 264/168 |
| 3,687,759 | 8/1972 | Werner | 264/168 |
| 3,691,004 | 9/1972 | Werner | 264/168 |
| 3,837,988 | 9/1974 | Hennen | 264/168 |
| 3,852,152 | 12/1974 | Werner | 264/168 |
| 3,936,337 | 2/1976 | Stapp | 264/168 |
| 4,012,249 | 3/1977 | Stapp | 156/167 |
| 4,212,692 | 7/1980 | Rasen et al. | 156/167 |
| 4,293,604 | 10/1981 | Campbell | 429/92 |
| 4,351,683 | 9/1982 | Kusilek | 156/167 |
| 4,761,318 | 8/1988 | Ott | 428/95 |
| 4,8591,516 | 8/1989 | Yamanaka et al. | 428/92 |
| 4,913,757 | 4/1990 | Yamanaka et al. | 156/167 |
| 4,952,265 | 8/1990 | Yamanaka et al. | 156/167 |

FOREIGN PATENT DOCUMENTS

| | | |
|---|---|---|
| 0919371 | 1/1973 | Canada . |
| 47-14347 | 4/1972 | Japan . |
| 62-85061 | 4/1987 | Japan . |
| 1269108 | 11/1969 | United Kingdom . |

*Primary Examiner*—Steven D. Maki
*Attorney, Agent, or Firm*—Ladas & Parry

[57] ABSTRACT

A method for producing a mat including a three dimensional filament loop aggregate comprises extruding molten thermoplastic synthetic resin die to form a plurality of filaments. The filaments are heated and descend onto a surface of a cooling liquid, between a pair of rotatable rolls submerged in the cooling liquid. The filaments are all cooled simultaneously by the cooling liquid and form loops on the surface thereof. A first series of loops formed from outermost filaments are supported on one of the rotatable rolls in the cooling liquid, with the loops being horizontal. Rotation of the roll moves these loops into a vertical position. Thereafter, all the loops are integrated, with the loops formed by the outermost filaments being in a vertical position, and the loops formed by the remaining filaments being in the horizontal position. A three dimensional filament loop aggregate is formed by integration of the loops, and is drawn off from between the rotatable rollers at a speed slower than the loops are formed on the surface of the liquid.

12 Claims, 2 Drawing Sheets

METHOD OF PRODUCING MAT COMPRISING FILAMENT LOOP AGGREGATE

BACKGROUND OF THE INVENTION

1. Technical Field

This invention relates to a method of producing a mat comprising a filament loop aggregate and more particularly to a method of producing a mat suitable as porch mat, floor mat or the like comprising a filament loop aggregate formed from thermoplastic synthetic resin.

2. Prior Art

The method of producing such mat is well known, for example, from (1) U.S. Pat. No. 4,351,683 and (2) U.S. Pat. No. 4,913,757.

However, according to the method as disclosed in (1), the filaments of one outermost row are cooled as they come into contact with a rotatable roll located to be exposed above the surface of cooling liquid and the remaining filaments are cooled by cooling liquid during formation of the filament loops. In other words, both the cooling conditions and the cooling timing are not even for all the filmanents and consequently there occurs a differential temperature among the filaments. It is therefore very difficult for this method to achieve uniform formation of the filament loops as well as adequate inter-filament setting. Moreover, this method is so arranged that the filaments of the outermost row come into contact with the lateral side of the rotatable roll to form successive loops lying fallen in a vertical plane which are often variable in shape and state.

According to the method as disclosed in (2) also, the filaments of one outermost row are cooled and successively formed into loops lying fallen in a vertical plane as descend onto a belt suspended above the surface of cooling liquid while the remaining filaments are cooled and successively formed into loops as they are submerged into cooling liquid. Accordingly, this method is necessarily accompanied with the problem similar to that encountered by the method disclosed in (1).

In conclusion, it is difficult for these methods of prior art to achieve a desired structural uniformity of the product since the loop forming conditions inclusive of the temperature condition are not uniform for all the filaments.

Based on findings that the filament loops may be formed under the conditions evenly set for all the filaments to achieve a structural uniformity and an improved quality of the final product, it is a principal object of the invention to provide a method of producing a mat comprising filament loop aggregate formed under the operative conditions evenly set for all the filaments.

It is another object of the invention to provide a method of producing a met with one or both of its opposite main surfaces being smooth, which presents appropriate elasticity, comfortableness to use and high durability.

It is still another object of the invention to provide a method of producing a mat having a high quality achieved by a uniform filament density of the filament loop aggregate.

SUMMARY OF THE INVENTION

To achieve the objects set forth above, the invention generally resides in a method of producing a mat formed by a three-dimensional filament loop aggregate 12, said method comprising steps of: extruding molten thermoplastic synthetic resin from a die 1 to form a plurality of filaments 2 which are, in turn, heated at a high temperature until they descend onto the surface 18 of cooling liquid 3 in a zone defined between a pair of rotatable rolls 5, 6 (first and second rotatable rolls) fully submerged in cooling liquid 3 with their tops 7, 8 being not exposed above the surface 18 of cooling liquid 3; simultaneously cooling the filaments 2 by the cooling liquid 3 and thereby forming filament loops 9, 10, 11 on the surface 18 of cooling liquid 3; supporting the loops 9 formed by the filaments 2*a* of one outermost row successively on the arc-shaped top 7 of the one rotatable roll 5 submerged in cooling liquid 3 so that these loops 9 may be horizontally supported on said arc-shaped top 7 of the roll 5 and then descend again so as to be successively lying fallen in a vertical plane as the roll 5 rotates; under a width regulation by the pair of rotatable rolls 5, 6, integrating said loops 9 lying fallen in a vertical plane with the filament loops 10, 11 formed on the surface 18 of cooling liquid 3 and lying fallen in horizontal layers under a width regulation by the pair of rotatable rolls 5, 6; and taking off the filament loops 9, 10, 11 thus integrated together at a speed lower than a speed at which the filaments descend toward the surface 18 of cooling liquid 3 to form said three-dimensional filament loop aggregate 12 composed of the filament loops 9 lying fallen in a vertical plane (lying fallen in a horizontal plane when actually used)so as to cover at least one surface of the aggregate 12 and the remaining filament loops 10, 11 lying fallen in horizontal layers (standing upright during actual use).

Preferably, the filaments 2 formed by extruding molten thermoplastic synthetic resin from the die 1 are heated at a high temperature by heating means 4 until the filaments 2 descend onto the surface 18 of cooling liquid 3 in the zone defined between the pair of rotatable rolls 5, 6 fully submerged in cooling liquid 3 with their tops 7, 8 being not exposed above the surface 18 of cooling liquid 3 and cooling liquid 3 is boilded in said zone defined between the pair of rolls 5, 6 as the heated filaments 2 descend into cooling liquid 3; and the filament loops 9, 10, 11 are formed on the surface 18 of cooling liquid 3 in a boiled state as the filaments are cooled by cooling liquid 3.

Preferably, there is provided a supporting roll 13 wherein the first rotatable roll, the second rotatable roll and the supporting roll each have an axis and the first rotatable roll, the second rotatable roll and the supporting roll are arranged so that the axis of the first rotatable roll, the axis of the second rotatable roll and the axis of the supporting roll define an acute triangle; and the supporting roll is provided in a descending path along which the filament loop aggregate 12 descends in cooling liquid 3 as near the one rotatble roll 5 as possible so that the filament loop aggregate 12 may be at least partially supported from below by said supporting roll 13 and taken off at a constant speed as said supporting roll 13 rotates.

Preferably, there is provided an auxiliary roll 16 in opposition to the supporting roll 13 approximately at a midpoint of the path followed by the filament loop aggregate 12 together with the periphral surface of the supporting roll 13 on which the aggregate 12 is held.

The filaments 2 are heated at substantially the same temperature as the temperature at which the molding compound is extruded from the die 1, i.e., at the temperature as high as of 180° C. to 200° C. and descend toward a zone of cooling liquid 3 defined between the pair of rotatable rolls 5, 6 fully submerged in cooling liquid 3 with their tops 7, 8 being not exposed above the surface 18 of cooling liquid 3 and adapted to be rotated at a speed lower than the speed at which the filaments 2 descend toward the surface 18 of cooling liquid 3.

Accordingly, the filaments 2 kept in molten state do not come into contact with the rotatable rolls 5, 6 in air until they reach the surface 18 of cooling liquid 3, thereupon the molten filaments 2 are simultaneously cooled by cooling liquid 3 of the uniform formulation (such formulation will be exemplarily shown in Examples 1 and 2 as will be described) to form respective loops. Such arrangement allows the loops to be formed with a qualitative uniformity and additionally allows setting of the loops at their inter-filament contact points as well as integration of all the loops to be smoothly achieved.

Cooling liquid is maintained at a temperature of 60° C. to 80° C. so that a zone in cooling liquid 3 defined between the rotatable rolls 5, 6 may be boiled as the filaments 2 heated at a temperature as high as of 180° C. to 200° C. descend into cooling liquid 3 and an agitating effect of cooling liquid 3 in such boiled state contributes to increase the contact points among the loops.

Of the filament loops 9, 10, 11 formed on the surface 18 of cooling liquid 3, the filament loops 9 formed by the filaments 2*a* of at least one outermost row are once horizontally supported in well-balanced state on the arc-shaped top 7 of the one roll 5-fully submerged in cooling liquid 3 and then descend again so as to lie fallen in a vertical plane (See FIG. 2).

In this manner, the filament loops 9 formed by the filaments 2*a* of the one outermost row are integrated with the filament loops 10, 11 formed by the remaining filaments 2*c*, 2*b* so as to lie fallen in horizontal layers under a width regulation by the pair of rotatable rolls 5, 6 and taken off at a speed lower than the speed at which the filaments 2 descend toward the surface 18 of cooling liquid 3 and formed into the three-dimensional filament loop aggregate 12 as the supporting roll 13 rotates.

In the three-dimensional filament loop aggregate 12 formed in this manner, the loops 9 coverting at least one surface thereof are lying fallen in a vertical plane (lying fallen in a horizontal plane when actually used) and the remaining filament loops 10, 11 are lying fallen in horizontal layers (standing upright when actually used). Accordingly, when the product 17 is actually used, the loops 9 lying fallen in a vertical plane (lying fallen in a horizontal plane when actually used) covers one surface of the product and thereby to provide the product with a smooth, flat surface while the loops 10, 11 lying fallen in horizontal layers (standing upright when actually used) provide the product with an appropriate elasticity.

The filament loop aggregate 12 submerged in cooling liquid 3 is at least partially supported by the supporting roll 13 provided in the descending path 14 along which the filament loop aggregate 12 descends in cooling liquid 3 and taken off at a constant speed as the supporting roll 13 rotates. By adjusting this take-off speed, the filament loop aggregate 12 being integrated from the filament loops in cooling liquid can be controlled to have a uniform filament density.

Specifically, the method of the invention allows the filament loop aggregate 12 to be smoothly and precisely transported and thereby allows the travelling speed (take-off speed) of the filament loop aggregate 12 in the "effective zone"(a zone of cooling liquid defined by a width between the rotatable rolls 5, 6, on one hand, and by a depth of approximately 30 mm downward from the surface 18 of cooling liquid 3, on the other hand) to form the three-dimensional filament loop aggregate 12 to be precisely controlled so that the filament loop aggregate 12 may have a uniform filament density.

The method of the invention allows also the filament loop aggregate 12 of a desired filament density to be easily formed.

BRIEF DESCRIPTION OF THE DRAWINGS

The invention will be described more in details with reference to the accompanying drawings, in which.

DESCRIPTION OF THE PREFERRED EMBODIMENT

Figure 1:
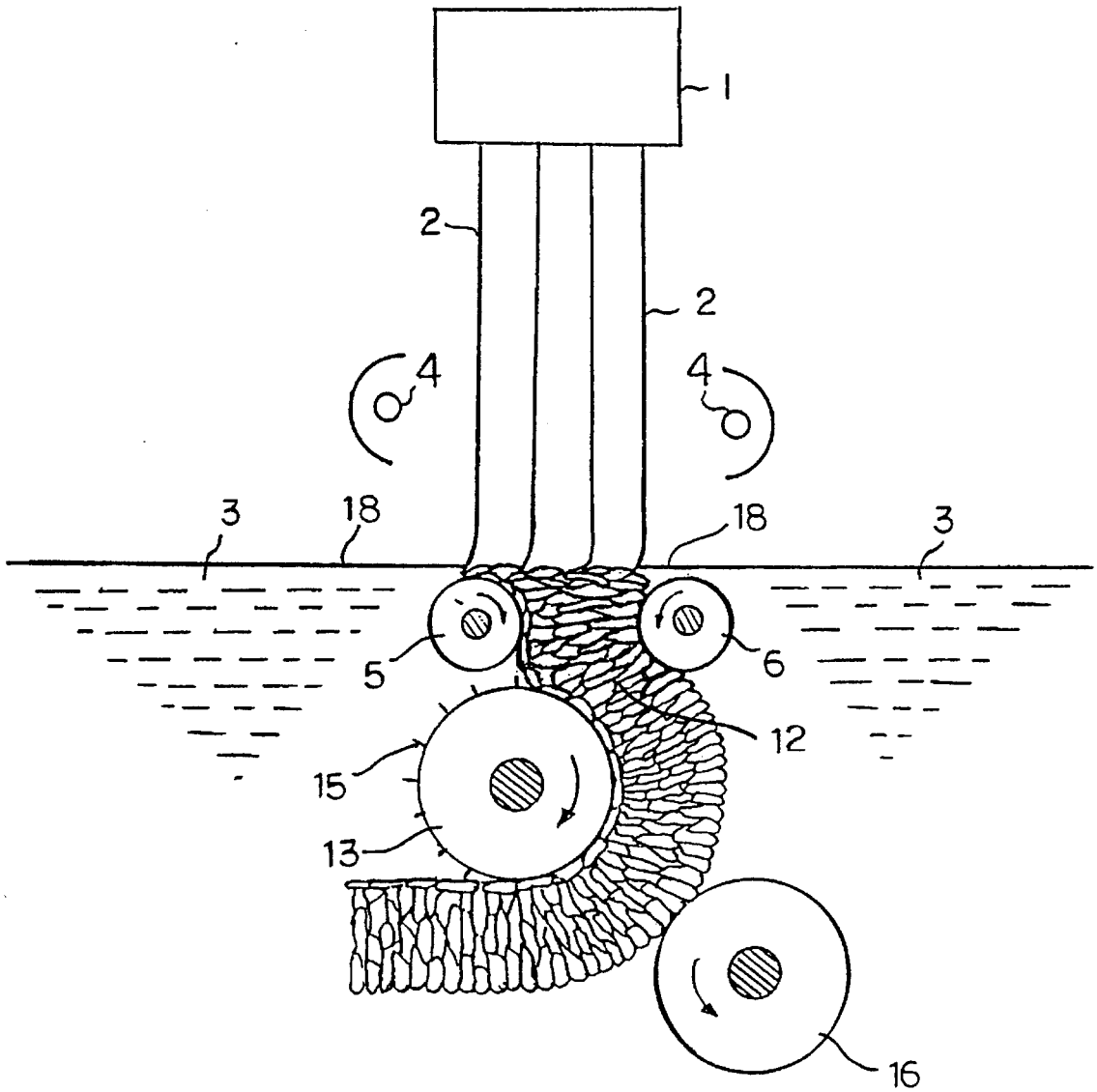
FIG. 1 is a schematic diagram illustrating the inventive method of producing a mat comprising a filament loop aggregate.

Referring to the drawings, molten thermoplastic synthetic resin is extruded under a predetermined pressure from a die 1 and thereby a plurality of filaments are continuously formed in alignment with one another at regular intervals lengthwise and crosswise with respect to a horizontal cross-section of the die 1 so that the filaments 2 continuously descend toward cooling liquid 3. On both sides of the filaments 2 descending toward cooling liquid 3, there are provided heating means 4 such as ceramic far infrared ray heaters serving to maintain these descending filaments 2 at a temperature of 180° C. to 200° C. at which the filaments 2 have been extruded from the die 1. Otherwise, the filaments 2 would be quenched as soon as the filaments 2 are extruded and exposed to the ambient air. To avoid this, the filaments 2 are heated by said heating means 4 so as to maintain them at a proper temperature and thereby formation of loops on the surface 18 of cooling liquid 3 is facilitated. It should be understood that higher the temperature of molten thermoplastic synthetic resin is, smaller the filament loop diameter is and lower the temperature of molten thermoplastic synthetic resin is, larger the filament loop diameter.

In cooling liquid 3, there are provided a pair of rotatable rolls 5, 6 rotating in the directions as indicated by arrows, respectively, at a speed lower than the speed at which the filaments 2 descend toward cooling liquid 3. The filaments 2 descend onto the surface 18 of cooling liquid 3 at a zone defined between the pair of rotatable rolls 5, 6. The rotatable rolls 5, 6 are fully submerged, i.e., tops 7, 8 of the respective rolls 5, 6 are not exposed above the surface 18 of cooling liquid 3. Consequently, all the filaments 2 directly descend onto the surface 18 of cooling liquid 3 without coming into contact with the respective rotatable rolls 5, 6 above the surface 18 of cooling liquid 3, and all the filaments 2 are simultaneously cooled by cooling liquid 3 so as to form filament loops 9, 10, 11 on the surface 18 of cooling liquid 3.

Cooling liquid 3 is normally maintained at a temperature of 60° C. to 80° C. and boiled in a zone defined between the rotatable rolls 5, 6 as the filaments 2 heated at a temperature as high as of 180° C. to 200° C. descend into cooling liquid 3. It is one the surface 18 of cooling liquid 3 in such boiled state that the filament loops are formed.

The loops 9 formed by the filaments 2*a* of one outermost row are once supported somewhat horizontally in well-balanced state on the arc-shaped top 7 of the associated roll 5 fully submerged in cooling liquid 3 and then descend again so as to be lying fallen in a vertical plane as the roll 5 rotates.

Supporting the loops 9 formed from the filaments 2*a* of the one outermost row on the arc-shaped top 7 of the associated roll 5 in well-balanced state facilitates the outermost uniform loops 9 to be orderly and continuously formed. To achieve this, it is preferably arranged so that the outermost filaments 2*a* formed by extruding molten thermoplastic synthetic resin from the die 1 vertically descend onto the top end of the associated roll 5 submerged in cooling liquid 3 or a little to the left thereof. It should be understood, however, that the invention is not limited to this specific arrangement.

Figure 2:
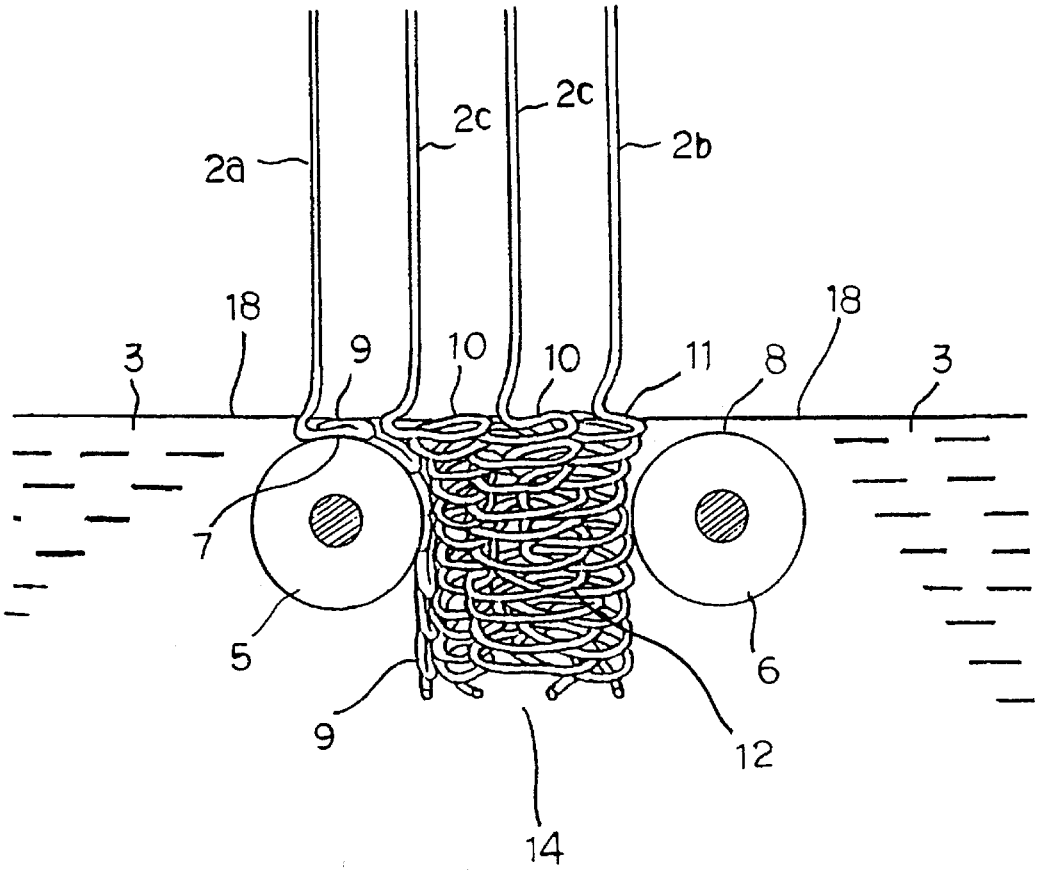
FIG. 2 is a schematic diagram illustrating formation of filament loops on the surface of cooling liquid and formation of the filament loop aggregate in cooling liquid.

Referring to FIG. 2, the above-mentioned alternative arrangment is illustrated, in which the filaments 2*a* of the one outermost row descend onto a little to the left of the top end of the associated roll 5 submerged in cooling liquid 3.

Each filament 2 has a diameter of 0.3 to 3 mm. The tops 7, 8 of the pair of rotatable rolls 5, 6 are preferably spaced approximately 10 mm or less downward from the surface 18 of cooling liquid 3. Each of these rotatable rolls 5, 6 preferably has a diameter of 15 to 30

The filament loops 9 of the one outermost row are integrated together with the filament loops 10, 11 formed from the remaining filaments 2*c* 2*b* so as to lie fallen in horizontal layers on the surface 18 of cooling liquid 3 under the width regulation by the pair of rotatable rolls 5, 6 and such integrated filament loops 9, 10, 11 are taken off at a speed lower than the speed at which the filaments 2 descend toward the surface 18 of cooling liquid 3 and thereby an aggregate 12 of three-dimensional filament loops is formed.

It should be understood that the loops 11 formed from the filaments 2*b* of the opposite outermost row have their outermost ends (i.e., right ends as viewed in FIG. 2) successively brought into a light contact with the associated rotable roll 6 in cooling liquid 3 and more or less irregularities which otherwise might possibly occur in these loops 11 are thereby corrected.

Figure 3:
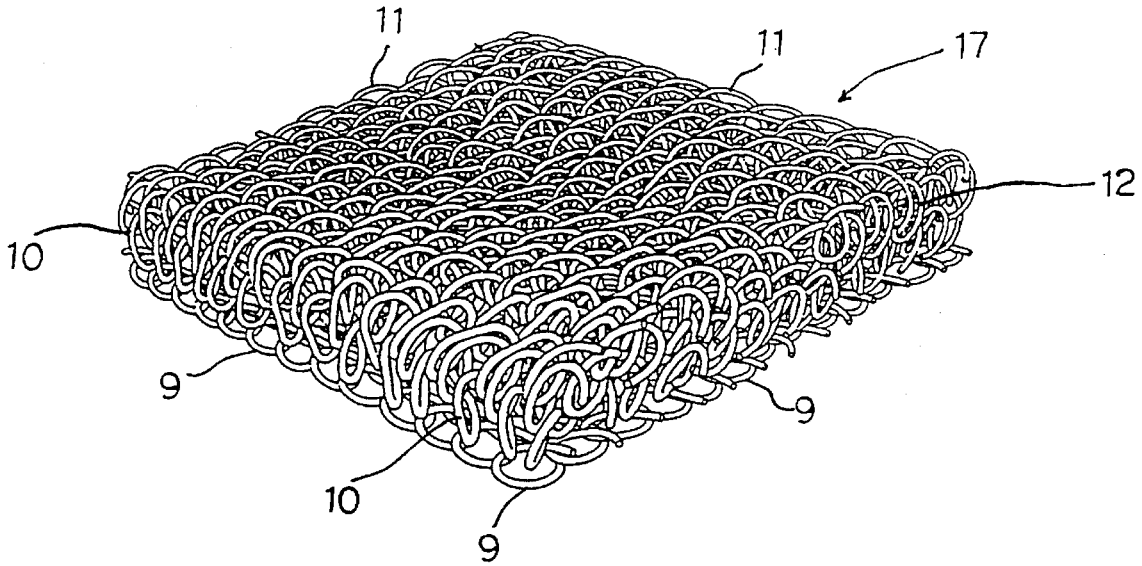
FIG. 3 is a perspective view of the mat comprising the filament loop aggregate formed utilizing the method of the invention.

In the three-dimensional filament loop aggregate 12, the filament loops 9 covering one surface of the aggregate 12 lie fallen in a vertical plane (lie fallen in a horizontal plane when actual used as shown by FIG. 3) and the remaining filament loops 10, 11 lie fallen in horizontal layers (stand upright when actually used as shown by FIG. 3).

Many filament loops 9, 10, 11 continuously formed on the surface 18 of cooling liquid 3 are then integrated together between the pair of rotatable rolls 5, 6 to form the three-dimensional filament loop aggregate 12. A zone within which such aggregate 12 can be effectively formed (referred to hereinafter as "effective zone") extends approximately 30 mm, more strictly, approximately 20 mm downward from the surface 18 of cooling liquid 3.

With the effective zone downwardly extending more than approximately 30 mm from the surface 18 of cooling liquid 3, it will be difficult to integrate the filament loops into the desired three-dimensional aggregate 12.

As previously mentioned, cooling liquid 3 is boiled in the zone defined between the pair of rotatable rolls 5, 6 as the hot filaments 2 descend and this boiling serves to vigorously agitate not only the surface 18 of cooling liquid 3 but also the amount of cooling liquid 3 within the "effective zone" so as to vibrate the points at which the individual loops are in contact one with another within the "effective zone", thus facilitating the loops to be firmly integrated together and thereby securing the filament loops to be formed into the filament loop aggregate of good integrity.

When the filament loop aggregate 12 is formed from the same number of component filaments (lengthwise four rows are used in the embodiment shown by FIG. 1), the resultant filament loop aggregate 12 will have different filament densities depending on a selected take-off speed in the "effective zone" within which the filament loops are integrated to form the three-dimensional filament loop aggregate 12.

Higher the take-off speed is, low the filament density the resultant filament loop aggregate 12 has (results in a coarse filament loop aggregate 12) and lower the take-off speed, higher the filament density the resultant filament loop aggregate 12 has (results in a dense filament loop aggregate 12). In any case, it is important to uniformize the filament density throughout the aggregate 12.

Uniform filament density will result in a three-dimensional filament loop aggregate 12 containing substantially uniform number of loops per unit volume, which is advantageous in that a product comprising such filament loop aggregate 12, for example, a mat 17, will have uniform properties such as an appropriate elasticity and offer a significantly improved comfortableness to use.

To assure such uniformity of the filament density, it is required to take off the filament loop aggregate 12 in the "effective zone" at a constant speed. However, the filament loops themselves are elastic and, immediately after these filament loops have been formed, not completely curved even though they have been cooled to some degree. Thus, not only the individual filament loops but also the filament loop aggregate 12 as a whole can be easily deformed in the course of formation. It is therefore very difficult to take off such easily deformable filament loop aggregate 12 at a constant speed in cooling liquid 3 without deformation thereof.

According to the invention, there is provided a supporting roll 13 in a descending path 14 along which a filament loop aggregate 12 descend in cooling liquid 3 and as adjacent as possible to the "effective zone" in which the filament loops are integrated together to form the three-dimensional filament loop aggregate 12 so that a filament loop aggregate 12 may be at least partially supported by said supporting roll 13 from below and thereby the take-off within the "effective zone" may be regulated to solve said problem.

The expression "descending path 14 along which a filament loop aggregate 12 descend in cooling liquid 3" should be understood as the path having a width determined by a distance between the pair of rotatable rolls 5, 6 and vertically extending in cooling liquid 3 downward from these rolls 5, 6 so that the filament loop aggregate 12 may descend by its own gravity along this descending path 14.

More specifically, the supporting roll 13 is provided in said descending path 14 of the filament loop aggregate 12 closely adjacent the one roll 5 so that the filament loop aggregate 12 may be at least partially supported from below and taken off by said supporting roll 13 at a constant speed as said supporting roll 13 rotates.

In the case shown by FIG. 1, the supporting roll 13 is provided in the path 14 along which the filament loop aggregate 12 descends in cooling liquid 3, more specifically, with the right end of this supporting roll 13 being located a little to the right of the midpoint between the pair of rotatable rolls 5, 6 (i.e., a little to the right roll 6) and the descending filament loop aggregate 12 is unforcedly supported thereby from below.

Though not shown, the supporting roll 13 may be, instead, located a little to the left of the midpoint between the pair of rotatable rolls 5, 6 (i.e., a little to the rotatable roll 5) so far as the supporting roll 13 exists in the descending path 14 of the filament loop aggregate 12.

The supporting roll 13 supports the filament loop aggregate 12 descending along the path 14 in cooling liquid 3 in the proximity of the one rotatable roll 5 (i.e., closely adjacent the "effective zone" in which the filament loop aggregate 12 is formed), thereby preventing the partially cured filament loop aggregate 12 from being distorted and, at the same time, controlling the filament loop aggregate 12 to be transported at a constant speed.

In other words, travelling of the filament loop aggregate 12 in the "effective zone" for its complete formation is controlled at a constant speed and thereby the uniformity of filament density in the filament loop aggregate 12 is assured.

In cooling liquid 3, the filament loop aggregate 12 is caught by pins 15 planted on the peripheral surface of the supporting roll 13 and temporarily held thereon so as to be transported on the supporting roll 13 as the latter rotates approximately by a half rotation (180° ) or more.

Even if a course of such transport is relatively long, the filament loop aggregate 12 follows a precisely same course without any significant deviation from this course, since the filament loop aggregate 12 travels as it is held on the supporting roll 13.

As additional means to guide the filament loop aggregate 12 more precisely along the expected course along which it should travel, there is provided an auxiliary roll 16 opposed to said supporting roll 13 so that, approximately at the midpoint of said half rotation, the filament loop aggregate 12 may be guided also with the opposite side thereof by this auxiliary roll 16.

The surface of the filament loop aggregate 12 covered with the loops 9 lying fallen in a vertical plane (lying fallen in a horizontal plane when actually used) is temporarily held by engagement with the pins 15 planted on the supporting roll 13 and such engagement is sufficiently reliable to prevent the filament loop aggregate 12 from deviating from its expected course during its travelling together with the peripheral surface of the supporting roll 13.

The filament loop aggregate 12 travels without deviation from its expected course together with the peripheral surface of the supporting roll 13 on which the aggregate 12 is temporarily held and therefore no deformation of the filament loop aggregate 12 occurs during its travelling in cooling liquid 3. In this way, the feed speed (i.e., take-off speed) of the filament loop aggregate 12 can be precisely controlled.

While the invention has been described above as the filaments 2*a* of only one outermost row are supported on the top 7 of the associated rotatable roll 5, it is also possible within the scope of the invention to support the filaments of two or more outermost rows in the same manner, though not shown.

More specifically, in addition to the filaments 2*a* of one outermost row, the filaments 2*b* of the opposed outermost row also may be supported on the arc-shaped top 8 of the other rotatable roll 6 to form a filament loop aggregate having opposite surfaces covered with the loops lying fallen in a vertical plane, though not shown.

The filament loop aggregate 12 is taken off by guide rolls or the like (not shown) from cooling liquid 3 to produce a mat 17 comprising such filament loop aggregate 12. It will be appreciated that the filament loop aggregate 12 may be subjected to any subsequent process such as coloring, if necessary.

It is also possible to provide the filament loop aggregate 12 with a backsheet made of synthetic resin or the other appropriate material, for example, bonded to the underside thereof, though not shown.

Referring to FIG. 3, there is illustrated, in a perspective view, a mat 17 comprising the three-dimensional filament loop aggregate 12 produced by the method according to the invention.

This mat 17 has one surface (corresponding to the bottom surface thereof when the mat is actually used as shown by FIG. 3) covered with the loops 9 lying fallen in a horizontal plane. These loops 9 have been formed by the filaments 2*a* of one outermost filament row at the formation stage of the filament loop aggregate 12 and allow the mat 17 to have a smooth bottom surface. The remaining portion of the mat 17 is composed of the filament loops 10, 11 standing substantially upright and complicatedly intertwining.

The other surface (corresponding to the top surface thereof when the mat is actually used) is neatly defined by top ends of the respective loops 11 lying on the same level with one another.

The invention will be understood further in details from the following examples but these examples are not intended to limit the invention.

EXAMPLE 1

| | |
|---|---|
| Polyvinyl chloride | 100 parts |
| Diisodecyl phthalate as plasticizer | 5.5 parts |
| Organic cadmium chelate | 0.5 parts |
| Cadmium stearate | 0.7 parts |
| Barium stearate | 0.3 parts |
| Coloring agent | 0.1 parts |

Molding compound of the above-mentioned composition is molded by an extruder into filaments.

The T-die includes plurality of filament molding orifices each having a diameter of 0.8 mm and arranged in four longitudinal rows at longitudinal piches of 8 mm and at transverse pitches of 5 mm. The T-die is 5.5 cm spaced above the surface 18 of cooling liquid 3.

One of the paired rotatable rolls has its top 7 which is 8 mm spaced (deep) from the surface 18 of cooling liquid 3. Each of the paired rolls has a diameter of 17 mm. The paired rolls (strictly, left end and right end thereof, respectively) are 15 mm spaced from each other. The T-die is heated at a temperature of 190° C. A die pressure is set to 80 kg/cm$^2$ and an extruding pressure is set to 190 kg/cm$^2$. A pair of ceramic far infrared ray heaters each of 2.5 KW are used as the heating means. With a molding linear speed set to 2.5 m/min., loops can be formed at a speed of 50 cm/min.

Under the molding conditions as mentioned above, an aggregate 12 is formed with a filament diameter of 1 mm, a loop diameter of approximately 7 mm and a thickness of 14 mm.

EXAMPLE 2

The same molding compound as in Example 1 is employed.

The T-die includes filament molding orifices each having a diameter of 0.4 mm and arranged in four longitudinal rows at longitudinal pitches of 6.6 mm and at transverse pitches of 3.5 mm. The T-die is 5 cm spaced above the surface 18 of cooling liquid 3.

One of the paired rotatable rolls has its top 7 which is 5 mm spaced (deep) from the surface 18 of cooling liquid 3. Each of these paired rolls has a diameter of 17 mm. The paired rolls (strictly, left end and right end thereof, respectively) are 10 mm spaced from each other. The T-die is heated at a temperature of 185° C. A T-die pressure is set to 150 kg/cm$^2$ and an extruding pressure is set to 180 kg/cm$^2$. A pair of ceramic far infrared ray heater of 2.5 KW are used as heating means. With a molding linear speed set to 3.5 m/min., loops can be formed at a speed of 70 cm/min.

Under the molding conditions as mentioned above, an aggregate 12 is formed with a filament diameter of 0.5 mm, a loop diameter of approximately 6 mm and a thickness of 9

This invention allows a product quality to be uniformized and improved by forming all the filament loops on the surface of cooling liquid under the uniform conditions.

The mat comprises a three-dimensional loop aggregate composed of loops lying fallen in a horizontal plane to cover at least one surface, for example, the bottom surface of the mat, thereby to assure a desired smoothness for the bottom surface and the loops standing upright and complicatedly intwining. In this manner, the method according to this invention is able to realize a mat excellent in durability as well as comfortableness to use.

Furthermore, the method according to this invention is able to assure a uniform filament density in the filament loop aggregate and such uniformity of the filament density contributes to improve the general quality and the comfortableness to use.

What is claimed is:

1. A method for producing a mat including a three dimensional filament loop aggregate, the method comprising:

extruding molten thermoplastic synthetic resin from a die to form a plurality of filaments including outer filaments and remaining filaments, heating the plurality of filaments and allowing them to descend from the die onto a surface of a cooling liquid, the plurality of filaments descending into a zone defined between a first rotatable roll and a second rotatable roll each having a top and being fully submerged in the cooling liquid such that the top of the first rotatable roll is 5–10 mm below the surface of the cooling liquid and the top of the second rotatable roll is approximately 10 mm or less below the surface of the cooling liquid;

cooling all of the plurality of filaments simultaneously with the cooling liquid, the outer filaments forming first loops and the remaining filaments forming second loops on the surface of the cooling liquid;

supporting the first loops on the top of the first rotatable roll in the cooling liquid, each of the first loops initially lying substantially horizontally on the top of the first rotatable roll and subsequently being rotated by the first rotatable roll to lie substantially vertically, the first loops forming on the top of the first rotatable roll being within the cooling liquid;

integrating the first loops, when substantially vertical, with the second loops to form the filament loop aggregate, the second loops being substantially horizontal during integrating, the first and second loops being integrated in the zone defined by the first and second rotatable rolls; and drawing off the integrated first and second filament loops from the zone at a speed lower than that speed at which the filaments descend towards the surface of the cooling liquid, whereby the filament loop aggregate is comprised of the first loops arranged in one plane and the second loops lying in a plane substantially normal thereto.

2. A method as claimed in claim 1 wherein the plurality of filaments are heated between the die and the surface of the cooling liquid, the cooling liquid is boiled in the zone, and the first and second filament loops are formed on the surface of the cooling liquid in its boiled state, the first and second filament loops all being cooled simultaneously by the cooling liquid.

3. A method as claimed in claim 1 wherein the outer filaments descend directly onto the top of the first rotatable roll.

4. A method as claimed in claim 1 wherein the outer filament descends from the die so as to contact the first rotatable roll at a point thereon spaced from the top thereof, such that the outer filament, upon rotation of the first rotatable roll, subsequently passes over the top of the first rotatable roll.

5. A method as claimed in claim 1 further comprising supporting the filament loop aggregate on a supporting roll, the supporting roll being located in the cooling liquid below the first rotatable roll, the supporting roll drawing off the filament loop aggregate at a constant speed as the supporting roll rotates.

6. A method as claimed in claim 1 wherein the plurality of filaments are formed into first and second filament loops continuously on the surface of the cooling liquid and are integrated in a zone located between the first and second rotatable rolls, the zone having a width defined by the first and second rotatable rolls, the zone extending to a depth of approximately 30 mm from the surface of the cooling liquid, the filament loop aggregate being drawn off from the zone at a constant speed to achieve a uniformity of filament loop density.

7. A method as claimed in claim 1 wherein each of the plurality of filaments has a diameter in the range of 0.03 mm to 3 mm.

8. A method as claimed in claim 5 wherein the supporting roll has a diameter greater than a width of the zone and wherein an outer surface of the supporting roll is located a little to the right or left of the midpoint between the first rotatable roll and the second rotatable roll.

9. A method as claimed in claim 5 wherein the filament loop aggregate is temporarily held by pins mounted on a surface of the supporting roll so that the filament loop aggregate moves adjacent the surface of the supporting roll over approximately a half rotation of the supporting roll.

10. A method as claimed in claim 9 which includes further providing an auxiliary roll in opposition to the supporting roll, the supporting and auxiliary rolls both being in contact with the filament loop aggregate when the filament loop aggregate is approximately midway along the half rotation about the supporting roll.

11. A method of producing a mat including a three dimensional filament loop aggregate, the method comprising the steps of:

extruding molten thermoplastic synthetic resin from a die to form a plurality of filaments including outer filaments and remaining filaments, the plurality of filaments descending from the die onto the surface of cooling liquid between first and second rotatable rolls wherein the first rotatable roll and the second rotatable roll are fully submerged in the cooling liquid;

cooling the plurality of filaments simultaneously in the cooling liquid, the outer filaments forming first loops and the remaining filaments forming second loops on the surface of the cooling liquid;

supporting the first loops on a top of the first rotatable roll such that the first loops lie substantially horizontally on the top and thereafter move around upon rotation of the first rotatable roll to a substantially vertical plane;

providing a supporting roll in the cooling liquid below the first and second rotatable rolls, the first rotatable roll, the second rotatable roll and the supporting roll each having an axis and the first rotatable roll, the second rotatable roll and the supporting roll being arranged so that the axis of the first rotatable roll, the axis of the second rotatable roll and the axis of the supporting roll define an acute triangle, the first and second rotatable rolls and the supporting roll defining a zone for receiving the first and second loops with the first and second loops being integrated in said zone to form the filament loop aggregate wherein the filament loop aggregate is at least partially supported from below by the supporting roll;

transporting the filament loop aggregate first between the first and second rotatable rolls and thereafter between the supporting roll and the second rotatable roll to regulate the width and density of the filament loop aggregate;

providing an auxiliary roll; and transporting the filament loop aggregate between the supporting roll and the auxiliary roll.

12. A method as claimed in claim 11 wherein the filaments are heated at a high temperature by heating means between the die and the surface of the cooling liquid, the cooling liquid is boiled in the zone where the plurality of filaments are received on the surface of the cooling liquid, the boiling agitating the surface of the cooling liquid and facilitating the establishment of contact points between the first and second filament loops.

* * * * *